US009862894B1

(12) United States Patent
Murray

(10) Patent No.: US 9,862,894 B1
(45) Date of Patent: Jan. 9, 2018

(54) POST HYDROTREATMENT FINISHING OF LUBRICANT DISTILLATES

(71) Applicant: Thomas George Murray, Dallas, TX (US)

(72) Inventor: Thomas George Murray, Dallas, TX (US)

( * ) Notice: Subject to any disclaimer, the term of this patent is extended or adjusted under 35 U.S.C. 154(b) by 0 days.

(21) Appl. No.: 15/212,180

(22) Filed: Jul. 15, 2016

Related U.S. Application Data

(63) Continuation of application No. 14/488,926, filed on Sep. 17, 2014, now Pat. No. 9,394,495.

(60) Provisional application No. 62/349,441, filed on Jun. 13, 2016, provisional application No. 61/879,409, filed on Sep. 18, 2013.

(51) Int. Cl.

| | |
|---|---|
| ***C10G 21/00*** | (2006.01) |
| ***C10G 67/04*** | (2006.01) |
| ***C10G 53/06*** | (2006.01) |
| ***C10M 101/02*** | (2006.01) |

(52) U.S. Cl.
CPC ..... *C10G 21/00* (2013.01); *C10G 21/006* (2013.01); *C10G 53/06* (2013.01); *C10M 101/02* (2013.01); *C10G 2400/10* (2013.01); *C10M 2203/1006* (2013.01); *C10M 2203/1065* (2013.01)

(58) Field of Classification Search
CPC .. C10G 21/00; C10G 67/04; C10G 2300/302; C10G 2400/10
See application file for complete search history.

(56) References Cited

U.S. PATENT DOCUMENTS

| | | | | |
|---|---|---|---|---|
| 1,874,947 A * | 8/1932 | Ferris | C10G 21/22 208/330 |
| 1,976,544 A * | 10/1934 | Diggs et al. | C10G 21/06 208/271 |
| 2,079,885 A * | 5/1937 | Voorhees | C10G 21/04 208/318 |
| 3,617,476 A | 11/1971 | Woodle | |
| 4,085,036 A | 4/1978 | Murphy, Jr. et al. | |
| 4,770,763 A | 9/1988 | Kusayanagi et al. | |
| 6,103,101 A | 8/2000 | Fragelli et al. | |

FOREIGN PATENT DOCUMENTS

| | | |
|---|---|---|
| GB | 1 256 842 A | 12/1971 |
| GB | 1 295 502 A | 11/1972 |
| GB | 1 310 488 A | 3/1973 |

* cited by examiner

*Primary Examiner* — Randy Boyer
(74) *Attorney, Agent, or Firm* — Jack D. Stone, Jr.; Scheef & Stone, L.L.P.

(57) ABSTRACT

A method wherein either crude oil or a used oil lubricant is processed to produce an intermediate lube distillate which is then hydrotreated to produce a hydrotreated base oil which is then processed by solvent treatment to produce a higher viscosity index base oil (such as Groups II+ and/or III) and a lower viscosity index base oil (such as Groups I and/or II), in each case as compared with the viscosity index of the hydrotreated base oil. In the solvent treatment, one or more solvents are utilized to selectively separate higher viscosity index components from lower viscosity index components found in the hydrotreated base oil, and after the separations have occurred, the solvent is preferably recovered for re-use in the process.

12 Claims, 4 Drawing Sheets

POST HYDROTREATMENT FINISHING OF LUBRICANT DISTILLATES

CROSS-REFERENCE TO RELATED APPLICATIONS

This application is a continuation application of U.S. Pat. No. 9,394,495, formerly co-pending patent application Ser. No. 14/488,926, filed on Sep. 17, 2014, and issued on Jul. 19, 2016, which claims the benefit of U.S. Provisional Application No. 61/879,409, filed Sep. 18, 2013, and this application claims the benefit of U.S. Provisional Application No. 62/349,441, filed Jun. 13, 2016, all of which applications are hereby incorporated herein by reference, in their entirety.

FIELD OF THE INVENTION

Base oils are combined with special additives to create finished lubricants, such as motor oil, or any number of other lubricant products. After finished lubricants are employed in their application, they then become used lubricating oil and are usually sold, where they typically are blended with other waste streams, to be used as burner fuel or as feedstock to a re-refinery where a majority of it again becomes base oil.

BACKGROUND OF THE INVENTION

While most lube base oil is made from crude oil (and is sometimes referred to as virgin base oil), it is well known that used lubricating oil is an excellent feedstock for re-refining into base oil. Re-refining technologies include most commonly either distillation, thermal de-asphalting, or solvent de-asphalting, which create one or more intermediate liquids, certain of which are then further upgraded to create marketable base oil, most commonly either by clay treatment, hydrotreatment, or solvent extraction. In the 1960s, acid/clay treating was prevalent but was discontinued due to extensive by-product solids creation that became ground pollutants, creating many super-fund sites that incurred massive clean-up costs.

Technologies such as distillation, thermal de-asphalting, or solvent (often propane) de-asphalting may be referred to as recycling technologies since the major intermediate products created by these processes can be sold as a cleaner burning fuel oil (such as a marine diesel oil or MDO) or sold as vacuum gas oil (VGO), which can be feedstock to a conventional crude oil refinery. The intermediate products (MDO or VGO, which may also be referred to as "intermediate lube distillate") created by recycling technologies are unfinished and typically unsuited for use as lubricants without further improvement. Technologies such as clay treatment, hydrotreatment, or solvent extraction may be termed finishing technologies since these are used to "finish" the quality of the intermediate lube distillate into marketable base oil. When a recycling technology and a finishing technology are coupled together, they are generally referred to as a re-refining technology.

Solvent de-asphalting has been applied in various modes including as a standalone step in separation of asphaltenes and an intermediate lighter less contaminated material which can then be sold as a burner fuel or further processed into a base oil. U.S. Pat. No. 5,556,548 and U.S. Pat. No. 6,174,431 (Interline Hydrocarbons) disclose a process wherein used oil is mixed with a solvent (such as propane, acetone, isopropyl alcohol, or a suitable hydrocarbon) which is lighter than the used oil and the solvent carries above with it a substantially non-asphaltic stream, leaving the heavier asphaltic materials then separated out as a residual at the bottom. The oil and solvent are passed through an activated carbon filter to remove metallic compounds and the solvent is then evaporated and re-captured for re-use. Solvent de-asphalting logically is applied as an alternative process to distillation and as with distillation, the material that is created is not suitable for sale as a base oil. However, unlike distillation, solvent de-asphalting will leave relatively high level of metals remaining in the created product. For this reason, solvent de-asphalting is far less common a recycling technology than is distillation. In the instant invention, the non-asphaltic material created by solvent de-asphalting a used oil is referred to as intermediate lube distillate, even though technically the material is created by a solvent based process versus a distillation process.

There are other recycling and finishing technologies beyond those listed above. The key point is that an intermediate material is generally first created and this intermediate material is then further upgraded. For example, the intermediate lube distillate created for finishing is generally bounded by a boiling range on the low end in the 500 to 550 degree Fahrenheit (° F.) and below range (which removes lighter liquids and diesel) and, on the high end in the 1050 to 1100° F. and above range where heavier asphaltic type materials are removed. (Some recycling processes may use boiling ranges extending well into the mid to upper 600° F. range which would then include a spindle oil cut along with the lighter liquids and diesel that is removed prior to the finishing stage.) Knowledge of these factors and areas, along with fouling and corrosion issues and other variations on used oil distillation, are well known to one of ordinary skill in the art and do not require further explanation. Accordingly, the term describing an oil to be further upgraded by finishing into a base oil is "intermediate lube distillate". Intermediate lube distillate is preferably defined to include an oil derived in large part from used lubricating oil utilizing any process which has removed a majority of the lighter fractions that generally occur at 500 to 550° F. or below and removed a majority of the heavier fractions that generally occur at 1050 to 1100° F. and above. An intermediate lube distillate can also be derived from crude oil. For example, in refining most commonly in the past an intermediate lube distillate has been created by processing crude oil through atmospheric distillation, vacuum distillation, solvent extraction, and solvent de-waxing units. The intermediate lube distillate that is created by these units is then hydrotreated to make a virgin base oil. In addition, sometimes solvent de-asphalting of the vacuum distillation residuum (the heaviest boiling point components emerging from the bottom of the vacuum distillation column) creates a non-asphaltic stream that is further processed into an intermediate lube distillate that is then hydrotreated to make a virgin base oil.

In the past, re-refined base oil has been viewed as inferior in quality to virgin base oil, although as re-refining technologies have improved, this is no longer accurate. Used lube oil quality has also increased markedly with the dramatic improvement in the finished lubricants' quality from which the used oils are generated. Up until 2010, about 95% of all U.S. base oil was produced in large refineries (which use crude oil as feedstock) with specially designed process units creating virgin base oil from select streams within the refinery. Only about 5% of all base oils then produced in the United States were re-refined base oils. As re-refining economics, technology, and used oil product quality improved, more re-refineries have been announced or been constructed and, as of 2013, approximately 10% of all U.S. base oil is forecasted to be supplied by re-refineries.

Three key determinants of base oil quality are lower sulfur (to reduce harmful emissions), increased saturates (which improve oxidation stability, reduce sludge and deposit formation, and have other beneficial characteristics) and a higher viscosity index (VI). VI measures the rate of change in viscosity in response to a change in temperature. With lube oils, the lesser the change the better, and a higher VI number indicates less viscosity change in response to temperature change, and thus higher quality. Saturates are well known to have a smaller change in viscosity in response to temperature than aromatics and polar compounds, and thus have higher VIs. It is thus well known that a higher level of saturates in base oil increases quality as the more saturated base oils achieve higher VIs. In addition, within the saturates, paraffinic components are known to have a higher VI than naphthenic components.

Table 1 below provides the American Petroleum Institute's (API1509) classification of base oils by groups of generally increasing quality, based on sulfur, saturates, viscosity index (VI), or means of manufacture. Groups I, II, and III are mineral oils (i.e., thus made from crude oils), whereas Group IV and above are made from petro-chemicals (thus derived ultimately from natural gas). Most notable in Table 1 below is the requirement that Group III base oils equal or exceed a 120 VI. Base oil quality is increased as the group levels increase, and this is reflected in higher market pricing of these base oils.

TABLE 1

API Base Oil Group Classifications

| Group | Viscosity Index | Saturates and Sulfur | Other |
|---|---|---|---|
| I | 80-120 | <90% and/or >=0.03% | |
| II | 80-120 | >=90% and <0.03% | |
| III | ≥120 | >=90% and <0.03% | |
| IV | | | PAO Poly Alpha Olefin |
| V | | | Poly Esters (others) |
| VI | | Europe Only (ATIEL) | PIO (Poly Internal Olefins) |

Increasingly strict United States government regulatory requirements requiring reduced emissions and improved fuel economy are translated into specific performance requirements for automobile motor oils by a tripartite industry committee called ILSAC, which consists of automobile manufacturers, additive manufacturers, and base oil producers. The latest performance standards established by ILSAC are GF-5 and these became effective on Oct. 1, 2011. The ILSAC standards specify tests which focus on ensuring the finished lubricant (the base oil and additives together in combination) will achieve certain explicit measures of fuel efficiency, catalyst compatibility, minimum levels of wear and deposits, and most particularly of importance in the lighter lubricant viscosity range, a limitation on volatility. Over the years, the increased GF standards have translated into enormous pressure on both virgin base oil producers and additive manufacturers to improve their products by creating higher quality base oils and higher performance additive packages to create higher quality motor and engine oils. For base oils today, this means increased demand for higher quality Group II base oils and, in some cases, even Group III base oils. This ever upward quality trend has continued for many years and virgin base oil producers have been forced to upgrade their facilities to produce higher quality base oils to meet the more stringent emissions and fuel economy standards. Most of the smaller, less efficient refineries producing virgin base oil could not justify the capital upgrades and either shut down their base oil plants within the refinery, or shut down the refinery.

Increased demand for Group III base oils coupled with a limited supply of Group III base oils has resulted in a sustained increased price premium for Group III pricing over Group II base oils. For example, in the U.S. Gulf Coast, the average historical price for the three year period ending Jul. 31, 2013, for Group III base oil is $5.30 per gallon, Group II base oil is $4.24 per gallon, and Group I is $3.86 per gallon. Thus, Group III traded for $1.06 per gallon (or an average 25% price premium) over Group II and $1.44 per gallon over Group I (or an average 37% price premium). Despite the substantial price premium for Group III, it is generally cost prohibitive to upgrade existing virgin base oil plants and, in fact, there is currently no refinery (or re-refinery) in the United States producing Group III base oil. In Canada, one small plant produces Group III base oil which comprises the entirety of all current Group III production in North America (and is less than 2% of worldwide Group III production). Group III base oil production is concentrated in the Far East and Middle East, which have 61% and 26% of the worldwide Group III capacity, respectively, thus together comprising 87% of the world's Group III capacity. Newer Group III plants outperform most older U.S. plants which were not designed to produce Group III based oils.

While selection of a recycling technology will somewhat affect base oil quality, for a given used oil feedstock, selection of the finishing technology (clay treatment, hydrotreatment, or solvent extraction) is the largest single factor affecting re-refined base oil quality. A comparison of the three most common finishing technologies used in re-refining is shown in the table below.

TABLE 2

Comparison of Most Common Re-refining Finishing Technologies

| Finishing Technology | Base Oil Quality | Base Oil Yield | Capital Cost | Operating Cost |
|---|---|---|---|---|
| Clay Treatment | Low - higher sulfur<br>Low - low saturates<br>Low - VI small improvement | Good - (95%+) | Lower: Index = 1 | Low - clay use and moderate temperature |
| Hydro-treatment | Highest - lowest sulfur<br>Highest - highest saturate<br>Highest - VI much improved | Best - (98%+) | Highest: Index = 8 | Highest - due to hydrogen, high pressure and high temperature |
| Solvent Extraction | Low - higher sulfur<br>Mid - moderate saturates<br>Low - VI improved, but limited by yield loss | Worst - Base oil lost to extract (80% - 90%) | Moderate: Index = 3 | Low - some heat, electricity, chemicals, plus small solvent losses |

Hydroprocessing is considered to be the gold standard and is used to make Group II base oil but requires a capital cost far in excess of that required for solvent extraction or clay treatment. Under more severe process conditions such as temperatures above 700° F. and pressures above 1,500 psig, hydroprocessing is referred to as hydrocracking, and is used to make Group III base oil. Hydro-cracked base oils, even while exhibiting excellent volatility, anti-oxidation, viscosity response to temperature (viscosity index or VI), and low temperature characteristics, typically have poor solubility and lubricity qualities which then impair the hydro-cracked base oil's ability to be mixed with additives. Explanations of these impairments are well presented in U.S. Pat. No. 7,655,605 (Rosenbaum/Chevron) and in the July 2009 STLE magazine article "New Base Oils Pose a Challenge for Solubility and Lubricity" (pages 34 through 39). In addition hydrocracking results in material yield reductions with up to 40% of the material being lost as a lubricant. While hydro-cracking is employed in many large refineries to make virgin base oils, there are no known re-refineries employing hydro-cracking because, in the current market, the capital cost is too high and the yields of lube oil are too low to economically justify the large investment.

Hydrotreatment is commonly applied in re-refining under moderate hydrotreatment processing severities (less than 700° F. and below about 1,500 psig, and space velocities in the range of 0.5 to 2.0) since it is now capable of routinely producing re-refined base oil with VIs in excess of 110, saturates well in excess of 90%, and sulfur and nitrogen below 200 PPM, thus creating a higher quality Group II base oil. However, hydrotreatment is not yet demonstrated to be capable of cost effectively making base oils over a range of viscosities each of which has a 120 VI or more, and most particularly in the lighter viscosities of 100 to 150 SUS, although this may change in later years with continued quality improvement of used oil feedstocks.

To understand the limits of hydrotreatment, it is important to understand the means by which hydrotreatment improves base oil, which in turn requires some knowledge of base oil composition. Base oil may be classified into three groups of compounds: saturates, aromatics, and polars. Thus whether by volume or by mass, Base Oil=Saturates+Aromatics+Polars (olefins are excluded as they are not likely to be material). Aromatics and polar compounds are low VI liquids whereas saturated compounds are higher in a range of VIs. Thus, higher levels of aromatics and polars in base oil will reduce the base oil's VI, whereas increased saturates in base oil will increase VI. Under elevated temperatures and pressures, over a certain residence time, in the presence of hydrogen and over a catalyst, hydrotreatment converts much of the aromatics and polar compounds to saturated compounds, which may be paraffinic or naphthenic, thereby resulting in an increase in VI. Although both paraffins and napthenes are saturates, naphthenes have lower VIs than paraffins. Thus, the higher the proportion of paraffinic components to naphthenic components, the higher will be the resultant VI, which is desirable since higher VI lube oils have higher value.

Conversion of aromatics and polar compounds to saturates in hydrotreatment is primarily bounded by temperature, residence time, and pressure (leaving aside catalyst selection, hydrogen purity, and flow rate) with implications for base oil yields and capital cost. For example, there is an upper bound on temperatures above about the 650° F. to 700° F. range where increased residence time results in increased cracking and thus yield loss and coking of hydrotreating catalysts. Below the cracking temperatures, residence time can be increased (or alternatively stated, space velocity lowered), but there is a practical limit on results that can be achieved by increased residence time. Reaction dynamics limit product improvement to temperatures and residence times above which net conversion of aromatics and polars to saturates will begin to reverse.

Since the effectiveness of higher hydrotreatment temperature and longer residence time are effectively bounded, pressure is a third variable to consider. Creating a VI of 120 or more (thus a Group III) in base oil will often require pressures in the 2,000 to 3,000 psig range, which moves well above hydrotreatment and into hydrocracking ranges. The core challenge of higher pressure hydrotreatment is that when pressure is increased, particularly above 1,500 psig, there is a step change up in capital costs caused by increased cost of materials and construction. This is triggered by moving from pressure class 900#, which is rated to about 1600 psig (assuming carbon steel and 700° F.), to pressure class 1500#, which is rated to about 2600 psig (again assuming carbon steel and 700° F.). In addition, while certainly producing a 120+VI base oil, the higher pressures and temperatures used in hydrocracking increase cracking and thus increase base oil yield loss and incur more catalyst coking.

Under the moderate severities of hydrotreatment, capital costs and product yields are preserved in an economic range. However, based on today's typical used oil feedstocks, conventional hydrotreatment is limited in its ability to reduce aromatics and polars, and create higher VI saturates, which generally limits the upper bound VI to below 120 (thus not achieving Group III). While in some cases with certain feedstocks a higher VI can be achieved for some base oil fractions (more particularly heavy lube oils which tend to have higher VIs to begin with), re-refiners using hydrotreatment have not yet been able to consistently produce Group III base oils across the viscosity range, and thus must depend heavily on obtaining high feedstock quality, which is uncertain and expensive to segregate in most used oil gathering operations. Thus, based on all currently known operating technologies, it is not economically feasible with current used oil feedstocks to consistently create Group III base oils over a range of viscosities solely by hydrotreatment of used oils.

An alternative finishing technology is solvent extraction, which is commonly used to extract aromatic and polar compounds from various feedstocks. Solvent extraction can be applied to intermediate lube distillate to make base oil, but there is a low base oil yield as the material which is extracted from the intermediate lube distillate is not marketable as base oil (since it is rich in aromatics and polar compounds, it is a low VI stream). Furthermore, and equally importantly, the base oil created using solvent extraction from the intermediate lube distillate cannot achieve a low enough sulfur level or sufficient color for many applications. Typically, solvent extraction has been used to make Group I base oil and it has been applied in crude refining and used oil re-refining applications for many decades. As noted in U.S. Pat. No. 8,182,672 (Exxon-Mobil Research), "The solvent extraction process selectively dissolves the aromatic components in an extract phase while leaving the more paraffinic components in a raffinate phase. Naphthenes are distributed between the extract and raffinate phases . . . . One can control the degree of separation between the extract and raffinate phases by controlling the solvent to oil ratio, extraction temperature, and method of contacting distillate to be extracted with solvent." Increasing processing severity by increasing the solvent to oil ratio (e.g., the dosage) and/or temperature will increase base oil quality but will also increase the base oil yield loss to extract, which is a low valued material. This loss becomes cost prohibitive since base oil yield losses can exceed 20% to 30%, or even more, of the feed stream. Furthermore, the resultant base oil is generally still too high in sulfur for the transportation market which is a large, high value market application for lube oil. Due to its low yield and creation of inferior quality base oil, virtually all new plants targeting higher valued markets have rejected solvent extraction and instead adopted some form of advanced hydroprocessing. Clay treatment suffers from a number of issues including low base oil quality due to high sulfur and low saturate levels, and some yield loss and scalability challenges.

Some attempts have been made to achieve better performance in re-refining by coupling various technologies together. In U.S. Pat. No. 4,512,878 (Exxon-Mobil Research & Engineering Co.), a process is disclosed for using a heat soak (similar to thermal de-asphalting) followed by distillation and then finally hydrotreating the distilled material to create a base oil. In U.S. Pat. No. 4,125,458 (Exxon-Mobil Research & Engineering Co.), a process is disclosed for simultaneously de-asphalting and extracting a mineral oil feedstock. However, it is believed that such a process is not feasible for technical or economic reasons and was never commercialized. In U.S. Pat. No. 8,366,912 (ARI Technologies, LLC), an innovative process is disclosed by which solvent extraction is first employed to produce base oil and then the smaller aromatics/polars rich extract stream is further improved by hydrotreatment. Since the extract stream is a small portion of the total feed, this has the advantage of reducing required hydrotreatment capacity which is the most capital intensive finishing technology, although the primary cited advantage is improved base oil yield. Further disclosed, but not supported by test data, is that the base oil created directly by solvent extraction meets the Group I, II, or III specifications. In U.S. Pat. No. 7,261,808 (Shell Oil Company), a process is disclosed wherein solvent (propane) de-asphalting is first employed, followed by multiple stage hydrogen treatments, including demetallization, hydro-treating, de-waxing, and then further hydro-treating. While undoubtedly creating a highly improved base oil over what was originally contained in the used lubricating oil feedstock, this process is extremely capital intensive. Other patents that describe various means of distillation followed by solvent extraction include U.S. Pat. Nos. 4,021,333; 4,071,438; 4,360,420; 6,117,309; 6,319,394; 6,320,090; and 6,712,954.

Turning to the refining industry (which processes crude oil versus used oil), base oil processing technologies that were most commonly employed traditionally are distillation (atmospheric and then vacuum), followed by solvent extraction and then solvent de-waxing, and then finally, hydrotreatment. However, in place of the solvent de-waxing step, Chevron introduced hydro-isomerization where waxy compounds are changed into more beneficial compounds, which is then followed by hydro-cracking (replacing hydrotreatment). This process has been demonstrated to achieve highly positive results in multiple operating plants, producing extremely high quality base oils. An example of an alternative coupling of technologies is U.S. Pat. No. 6,325,918 (Exxon-Mobil Research & Engineering Co.) which first applies solvent extraction and then further improves base oil by hydrotreatment in what is called Raffinate Hydro-Conversion (RHC). Exxon-Mobil has successfully commercialized its RHC technology wherein solvent extracted base oils are then further improved by subsequent hydrotreating. In U.S. Pat. No. 3,781,196 a hydrocracked liquid which has accordingly been processed at high processing severities (namely above 650° F. which is a temperature range which promotes severe cracking in lubricants and pressures above about 1500 psig) is then followed by solvent extraction with the objective of stabilizing the color and reducing the sludge formation of the resulting products. Other examples of base oil refining processes are found in U.S. Pat. Nos. 7,597,795; 7,655,605: 7,682,502; and 7,914,665, and there are also many others.

Well before the 1950s, which began introduction of hydrotreatment and the development of increasingly effective catalysts, at least one solvent based technique was advanced to separate naphthenic and paraffinic streams in order to create a paraffinic rich stream and thus a higher value lubricant. In U.S. Pat. No. 2,070,384 (dated Feb. 9, 1937) is described a process where solvent extraction using two solvents, one paraffinic and one naphthenic, are each used to create a paraffinic rich stream which has a high viscosity index. In U.S. Pat. No. 2,771,494 dated Nov. 20, 1956, a process is disclosed in which 2-pyrrolidone is used in solvent extraction for separation of naphthenic hydrocarbons from paraffinic hydrocarbons. This patent cites creation of a 95 percent pure paraffinic stream and a 99 percent pure extract stream (solvent free basis) although the feed is not a distilled mineral oil but rather an equal mixture of homogeneous paraffinic and naphthenic hydrocarbon liquids. In later years in the 1990s, U.S. Pat. Nos. 5,095,170, 5,120,900, and 5,107,056 disclose membrane separation processes whereby naphthenic hydrocarbons preferably migrate across a barrier to leave a more paraffinic concentrated stream remaining. However, none of the prior referenced technologies disclose any means or methods whereby crude oil processing technologies, recycling technologies, or finishing technologies are able to cost effectively achieve consistent production of high quality base oil, whether derived from crude oil, used oil, or a combination thereof. Blending even small portions of used oils into crude oil incurs high operating risks due to contaminants found in used lubricating oils that are not typically found in crude oils.

In view of the foregoing, there is a need for a system and method for efficiently generating a high VI base oil with a minimal loss of yield in the resulting base oil products.

SUMMARY OF THE INVENTION

The disclosed invention utilizes hydrotreatment of an intermediate lube distillate in combination with a subsequent solvent treatment to create from the hydrotreated base oil stream at least one higher paraffinic, higher VI stream and at least one higher naphthenic, higher aromatic, higher polar lower VI stream with minimal loss in yield. Hydrotreatment of the intermediate lube distillate typically occurs at temperatures that are below the cracking range of base oils (cracking generally starts increasing materially above 650° F. and becomes prohibitive in the 700° F. area) and solvent treatment is a separations process which divides the hydrotreated base oil feed into two different streams with virtually zero loss of yield in the total (volume or mass) of the two streams, as compared with the hydrotreated base oil feed stream (on a solvent free basis).

Hydrotreatment process conditions as contemplated in the instant invention are preferably in the general ranges of 450° F. to 700° F., and 800 psig to 1,500 psig. These process conditions preferably result in a loss of less than 10% of the lube fraction, and more preferably result in a loss of less than 5% of the lube fraction, and most preferably result in a loss of less than 2% of the lube fraction, with the lube fraction being defined as a range in which the majority of the liquid to be hydrotreated has boiling points from 550° F. to 1050° F. at atmospheric pressure. Hydrotreatment achieves, improvement in color, reduction in hetero-atoms (sulfur, nitrogen, and oxygen), and conversion of unsaturated components (such as aromatics) to saturates. Many of the conversions from aromatics to saturates create naphthenic components, and hydrotreatment also may result in naphthene ring opening and isomerization, thus converting some naphthenes to paraffins, and some paraffins to iso-paraffins. Whereas in the intermediate lube distillate (and thus prior to hydrotreatment) each of such hetero-atoms may have been well in excess of 300 to 500 ppm dependent on the feedstock, in the hydrotreated base oil hetero-atoms may be reduced to below 100 ppm or even well below 10 ppm (thus indicating substantially total removal) for each of the sulfur and nitrogen. In the hydrotreated base oil, saturates content may increase by 5% to 10% or more and aromatics may be reduced by 5% or more as compared with the intermediate lube distillate (in measuring saturates and aromatics content different test methods will record different results but for purposes of the instant invention ASTM D-7419 is preferred over ASTM D-2007). The hydrotreated base oil is thus a much improved base oil over the intermediate lube distillate.

More specifically, in the instant invention solvent treatment is defined as applying one or more solvents which will: a. preferentially remove naphthenic, aromatic, or polar compounds from a hydrotreated base oil (as in the case of a solvent applied in solvent extraction) or b. preferentially remove paraffinic compounds from a hydrotreated base oil (as in the case of a solvent applied in solvent de-asphalting), or c. use a combination of both a. and b. approaches. The combination of the two approaches described in c. may be any sequence of, first a. then b., or first b. then a, or both a and b. being applied together simultaneously. In the case of a. and b. being applied simultaneously then solvent treatment will preferably include two solvents, namely a preferentially selective naphthenic/aromatic/polar solvent and a preferentially selective paraffinic solvent, being applied concurrently but at different entry points to a contactor, extractor, centrifuge, distillation column, or other device, which promotes separation of material by molecular weight and gravitational or centrifugal force. Under the operating conditions of the process, wherever two solvents (termed in the instant invention, dual solvents) are employed these dual solvents will preferentially not be miscible with each other but will instead preferentially have increased affinity for the higher VI or lower VI components which each is either removing or acting as a replacement for, such as for example paraffinic components in the case of one solvent, and aromatic/polar/naphthenic components in the case of the other solvent. In the case of dual solvents, temperature can have a particularly large impact wherein two solvents which are substantially immiscible at one temperature are substantially miscible at another temperature. Whether practicing a single solvent or dual solvents, in the instant invention all solvents are preferably recovered from the higher paraffinic and/or higher naphthenic streams and re-used in the process. In the instant invention the terms, constituents, compounds, and components are used interchangeably.

The key advantages of the instant invention where solvent treatment is applied after hydrotreatment are as follows:

a. By applying hydrotreatment first, most of the hetero-atoms (sulfur, nitrogen, and oxygen) are replaced with hydrogen, some aromatic and polar compounds are converted to saturates, and some naphthenes may be converted to paraffins or iso-paraffins, thus preserving base oil yield, since hydrotreatment occurs under conditions which minimize cracking and thus yield loss.
b. By applying solvent treatment second, the hydrotreated base oil is further enhanced by both selective separation of many of the aromatics and polar compounds that were not converted during hydrotreatment, and also selective separation of the saturated compounds into streams of more paraffinic and more naphthenic liquids. These separations are thus creating higher paraffinic and higher naphthenic streams, thereby creating higher VI and lower VI streams, respectively.
c. Because of the high quality of the hydrotreated base oil feed stream, as opposed to creating a low value reject stream as would occur when solvent extraction is applied to a non-hydrotreated liquid, each of the higher VI and lower VI streams are preferably marketable as base oils. For example, if the VI of the lower VI stream equals or exceeds 80, it will achieve at least a Group I base oil classification. And if the naphthenic content of the lower VI stream is sufficiently high, it can be marketed into specific applications where it can be most effectively utilized as, for example, in rail road applications.
d. By coupling together hydrotreatment and solvent treatment, each of the hydrotreatment and solvent treatment units are utilized optimally to achieve their suited product improvements.

In addition to the aforementioned, the process of the disclosed invention is further enhanced by the following innovations:

a. Use of heat from hydrotreatment to improve solvency power and/or minimize operating cost and capital cost in the contactor and in either or both of the raffinate and extraction sections for recovery of the solvent(s).
b. Use of pressure from hydrotreatment to improve solvency power and/or minimize operating and capital cost in the contactor and in either or both of the raffinate and extraction sections for recovery of the solvent(s).
c. Use of combinations of both heat and pressure from hydrotreatment to improve solvency power and/or minimize capital and operating cost in the contactor and in either or both of the raffinate and extraction sections for recovery of the solvent(s).
d. Sale as a higher naphthenic base oil of the solute created when applying solvent treatment to the hydrotreated base oil.
e. Sale of the solute created from extract resulting from applying solvent treatment to a hydrotreated base oil into markets which would otherwise reject this solute due to its high level of poly-nuclear aromatics (PNAs), which are known carcinogens.
f. Blending of the solute created from extract with an asphalt flux to further enhance the asphalt flux created in the distillation step which created the intermediate lube distillate which was then hydrotreated.
g. Burning of the solute created from the extract as fuel.

Innovations f and g. are preferably applied only if the hydro-treated material was of such low quality that the solute created from the extract could not be marketed as base oil.

Prior to disclosure of the invention herein, none of the aforementioned finishing technologies of hydrotreating, solvent extraction, clay treating, or any combination of these, have been shown to create high VI and low VI base oil streams using hydrotreated base oil as the feed. Accordingly, there is a need for a re-refining technology that can efficiently and consistently achieve the high base oil quality levels meeting the increasingly stringent lubricant performance standards which often require Group III base oils and a VI equal to or greater than 120.

The rationale for first applying hydrotreatment and then second applying a solvent treatment such as solvent extraction is by no means obvious. Solvent extraction is the old traditional approach which is coupled with solvent de-waxing and hydrotreatment in many older conventional refineries to make Group I base oils. But many of these older Group I plants have already shut down, or are announced as to be shut down in the future, or based on their poor economics, are expected to be shut down, as they become supplanted by plants using advanced hydoprocessing technologies such as raffinate hydro-conversion, iso-dewaxing, catalytic de-waxing, and gas-to-liquids technologies, which can make higher quality base oils such as Group II, II+, III, or even III+ base oils. As noted, the higher the group number and + indicate increasingly high VI numbers such as for example, Group II in this designation holding a VI of 90 to 115, II+ being a VI of 115-119, III having VI of 120 to 129, and III+ having VIs of 130 or more. Thus it is counter-intuitive to both refiners and re-refiners to apply solvent extraction after hydrotreatment because solvent extraction is perceived to be (and, in fact, actually is in a conventional sequence) an older, inferior processing technology that is not capable of making higher quality lubricating oils. Since hydrotreatment, and further hydroprocessing improvements over hydrotreatment, are widely accepted as the best finishing processes for creating high quality base oils, there is no perceived gain by subsequently applying an inferior technology such as solvent extraction to further upgrade a base oil that has already been hydrotreated. This perspective is common to both refiners and re-refiners as will be noted in the next paragraphs.

In refining, the lower perception of solvent extraction is well stated in U.S. Pat. No. 6,325,918 (Exxon-Mobil Research and Engineering) by the following quote, "In recent years, solvent extraction has been replaced by hydrocracking as a means for producing high VI basestocks in some refineries . . . [because] separation of the aromatics rich phase that occurs in solvent extraction is an unnecessary step since hydrocracking can reduce aromatics content to very low levels." However, this perspective fails to consider the huge capital cost of hydrocrackers, and the attendant yield loss in the range of 20% to 30% or more which results from the need to achieve the very high temperature and pressure processing severities which create very high VI base oils. The massive capital cost of hydrocrackers can only be justified in the very largest facilities whereas the capital cost of solvent treatment is far lower and, when applied after hydrotreatment as described in the instant invention, can still achieve a substantial VI improvement in the higher VI stream in virtually all instances without any loss of base oil (when comparing the incoming base oil stream with the sum of the higher and lower VI base oil output streams after the solvent(s) have been removed).

In re-refining, the perspective that only hydrotreatment (and not solvent extraction) produces the highest quality base oil is found in the following quotation from an October 2012 Lube Tech magazine article written by the leading licensor of re-refining technologies, Chemical Engineering Partners (CEP). CEP is an affiliate of the Evergreen Oil Re-refinery in Newark, Calif., which is a plant that has been in operation since the 1980s. CEP has licensed its technology to many re-refineries worldwide. In the article CEP noted " . . . lube base oil can be recovered and 'regenerated' to the quality equal to or better than its original virgin form by using a proper re-refining process such as Chemical Engineering Partner's (CEP) hydrotreating process. While there are other re-refining processes available, such as clay treatment and solvent extraction, the lube oil produced by those processes does not meet the specifications of API Group II base oil. This is because of their inability to reduce the sulphur concentration low enough to produce the API Group II base oil. They also suffer lower yield due to the loss of product inherent to their processes. For example, the solvent extraction process achieves a high saturates concentration by selectively extracting the aromatic compounds. However, doing so also removes valuable products from the total lube oil available in the used oil. CEP's hydrotreating process, instead, converts those aromatics into saturated hydrocarbons, hence maintaining the highest yield of base oil recovery among all re-refining processes." CEP does not mention that moderate severity hydrotreatment still leaves in the finished base oil a level of aromatics, polar, and naphthenic compounds which prevent CEP's base oil from attaining the high VIs that are required for Group III base oil.

In the preferred operating mode of the invention, a substantial portion of the much lower levels of polar and aromatic compounds that remain after hydrotreatment are effectively and efficiently captured in the extract stream via solvent extraction, and thus removed from the raffinate stream, creating an unexpectedly high VI base oil product from the raffinate stream. Because hydrotreating converts most aromatics and polar compounds into saturates, the remaining portion of aromatics and polar compounds in the solute that is created from the extract is much smaller. Should the hydrotreated feed stream to the solvent extraction unit be of a very low quality, the solute generated from the extract (solute being the material remaining after the solvent is distilled from the extract) may possibly not even meet the API base oil specifications for Group I. However, even in this scenario the instant invention offers the benefit of shifting a lower portion of the feedstream to non-base oil than would have been the case had solvent extraction been applied before hydrotreatment. In addition, hydrotreatment has already removed most of the sulfur and improved the color of the product, both of which solvent extraction has very limited effectiveness in achieving. Thus, when applied after hydrotreatment, both the higher VI and lower VI streams created by solvent extraction are low sulfur materials and better in color, each of which are extremely important for valuable base oil market applications.

The VI of the raffinate made from solvent treatment of the hydrotreated base oil is much improved because aromatic and polar compounds shifted to the extract stream during solvent extraction (and thus becoming part of the solute) have extremely low VIs, and these reduced the VI of the hydrotreated base oil prior to separation. The phenomenon of VI Hop (explained below) in this case results in a highly positive effect in that removing even small portions of the lowest VI materials generally has a greater than proportional effect on increasing VI. Finally, because the extract (and thus the solute) was created from a hydrotreated base oil, some environmentally damaging and dangerous impurities, such as poly-nuclear aromatics (PNAs) which are known carcinogens, were already converted or destroyed during hydrotreatment. This improves the solute to where it is preferably marketable as base oil, which is far more highly valued than being sold as burner fuel, or used as a blend component for making asphalt flux.

Depending on the quality of the intermediate lube distillate, hydrotreatment severity, and original quality of used oil feedstock, the solute created by post-hydrotreatment solvent extraction is prospectively marketable as a Group I or Group II base oil (with some feedstocks in theory it could even be a Group III base oil). Marketing the solute as base oil meeting any of the API base oil group classifications is the preferred mode of the invention. Selling the solute into alternative markets such as a blend material in making asphalt flux is the next most preferred alternative, and finally burning solute as fuel is the least preferred.

An alternative means for implementing the instant invention is to apply a solvent which is preferentially selective to paraffinic compounds, such as propane, thus creating from the raffinate a stream which is higher in paraffin components and a stream which is higher in naphthene components from the extract. In this example, the heavier hydrotreated lube oil is injected near the top of a contactor and a solvent with preference for paraffinic components (such as propane) is injected near the bottom of the contactor. With the two streams flowing counter-currently the paraffinic preferential solvent creates a paraffin rich raffinate stream overhead and a reduced paraffin (and thus more naphthenic) extract stream exiting the bottom of the contactor. In each of the paraffinic and naphthenic rich streams, the solvent is preferably then evaporated for recovery for re-use in the process. Two base oil streams, the higher paraffinic, higher VI from the raffinate, and the higher naphthenic, lower VI in the extract, are thus generated in this embodiment as well. Implementation of an approach where a paraffinic preferentially selective solvent is used, versus an aromatics/polar/naphthenic preferentially selective solvent, is believed to be well within the understanding of one of ordinary skill in the art. Similarly an embodiment of simultaneously using two solvents (referred to here as dual solvents), one which preferentially attracts paraffinic components and one which preferentially attracts aromatics/polars/naphthenics components, is also encompassed within the instant invention. A dual solvent embodiment could be applied in either, a sequence with a second stage of contactor preferably applied to the raffinate (higher quality) stream (without limitation as to which solvent type would be applied first), or with both solvents applied in a single contactor. Application of dual solvents is also intended to be encompassed as an embodiment of the instant invention.

An alternative mode for finishing is to utilize clay treatment on a hydro-treated base oil to further improve the post hydro-treated base oil to higher quality levels. However a key disadvantage of clay treatment versus solvent extraction is that a portion of the adsorbed material in the base oil is lost. Furthermore the clay, after several re-generations, ultimately must be disposed of as a waste material. With solvent extraction (which is strictly a separations process), all of the feed to the solvent extraction unit is separated and distributed between the base oil created from the raffinate stream or the base oil which is the solute created from the extract stream, and thus there is no waste stream.

Without in any way intending to limit the specific mechanisms of the invention, an explanation as to how solvent extraction increases VI is noted empirically in the following two citations. As cited in *Process Chemistry of Lubricant Base Stocks*, in Table 3.10 (Thomas R. Lynch, 2008, CRC Press), excerpts of which are noted below, a 150 SN lube feed is divided into 8 different fractions using a technique called thermal diffusion. Unlike distillation, which separates by molecular weight, thermal diffusion stratifies a material by molecular density and molecular shape, which in effect correlates closely with VI. It is thus shown that a single SN 150 lube liquid with a 105 VI actually consists of multiple fractions of highly varied compositions, ranging in VI from 171 on the high end down to 15 on the low end.

Table 3 below also shows that as the VI decreases in each fraction from 1 to 8, the paraffinic content is decreasing, and the aromatic and naphthenic portions of each fraction are increasing. However, this fact alone does not support whether solvent extraction will remove aromatics and naphthenic compounds to increase VI in the remaining base oil.

TABLE 3

SN 150 Lubricant Separation by Thermal Diffusion

| Fraction Number | VI (d2770) | Density | Carbon % aromatic | Carbon % napthenic | Carbon % - paraffinic |
|---|---|---|---|---|---|
| Feed | 105 | 0.867 | 3.3 | 33.2 | 63.5 |
| 1 | 171 | 0.810 | 0.0 | 4.5 | 95.5 |
| 2 | 162 | 0.817 | 1.0 | 6.7 | 92.3 |
| 3 | 146 | 0.827 | 0.6 | 17.0 | 82.4 |
| 4 | 143 | 0.833 | 0.0 | 22.7 | 77.3 |
| 5 | 110 | 0.862 | 0.0 | 38.7 | 62.2 |
| 6 | 82 | 0.882 | 3.9 | 39.4 | 56.7 |
| 7 | 59 | 0.900 | 7.9 | 39.5 | 52.6 |
| 8 | 15 | 0.931 | 5.2 | 57.0 | 37.8 |

Table 4 below completes the analysis since it conveys how a distillate that has been solvent extracted can then be evaluated by thermal diffusion to create a raffinate (base oil) with a dramatically higher VI than the aromatics (extract portion). Table 4 has been created utilizing FIG. 3.18 in Process Chemistry of Lubricant Base Stocks (Thomas R. Lynch, 2008, CRC Press). The distillate in Table 4 below is a derived intermediate distillate oil of some kind (such as a VGO) and thus not a base oil. In the instant invention, the feedstock on which solvent extraction is to be applied is instead a hydrotreated base oil that was created from an intermediate lube distillate.

TABLE 4

VIs of a Distillate, and its Associated Raffinate and Extract Streams, Measured by Thermal Diffusion

| Port => | 1 | 2 | 3 | 4 | 5 | 6 | 7 | 8 | 9 | 10 | Average |
|---|---|---|---|---|---|---|---|---|---|---|---|
| Raffinate | | | 150 | 140 | 110 | 100 | 80 | 70 | 50 | −100 | 75 |
| Distillate | | | 150 | 120 | 80 | 70 | 20 | −100 | −250 | −200 | −14 |
| Aromatic | 180 | 105 | 50 | 0 | −100 | −180 | −340 | −460 | −410 | | −128 |

Table 4 shows that the arithmetic mean (average) of the raffinate fractions' VIs is 75. This is materially higher than that of either the mean distillate VI of −14 (from which the raffinate was made during solvent extraction) or the mean extract VI of −128. It may be further noted that the average of the raffinate VI and extract VI is −26.5, which is well below the distillate (feed) VI of −14. The phenomenon where blended VI is higher than the average of the VIs in the blend is known as "VI Hop". A key implication of VI Hop with respect to the invention is that as low or even negative VI liquids are removed from the post-hydrotreated base oil, there is a disproportionately greater increase in the higher VI base oil's VI number. Table 4, unlike Table 3, does not divide out the naphthenic portion, which as noted above is considered by some to be distributed between the paraffinic and the aromatic streams.

Table 3 above thus supports in each base oil a varied composition of liquids holding different VIs. Further analysis of Table 4 above supports a direct and positive correlation between solvent extraction's creation of a stream with a higher proportion of paraffins with attendant higher VI numbers versus a stream with a higher proportion of aromatics compounds with lower VI numbers. Thus it is clear that a base stock liquid consists of elements with higher and lower VIs and it is further shown that solvent extraction separates components of lower VIs from components of higher VIs, thus enabling a higher VI base oil in the raffinate stream. This mechanism noting removal of aromatics by solvent treatment is by no means intended to limit its application to the exclusion of removal of polar and naphthenic components as well. In fact, polar and naphthenic components are highly likely to also be removed by one or more solvents with a high affinity for removal of aromatic compounds. Thus, the mechanism of one embodiment of the instant invention, applying solvent extraction after hydrotreatment to a hydrotreated base oil, has a demonstrated beneficial effect on improving the VI, and thus the value, of a large portion of the post-hydrotreated base oil.

DESCRIPTION OF THE INVENTION

Figure 1:
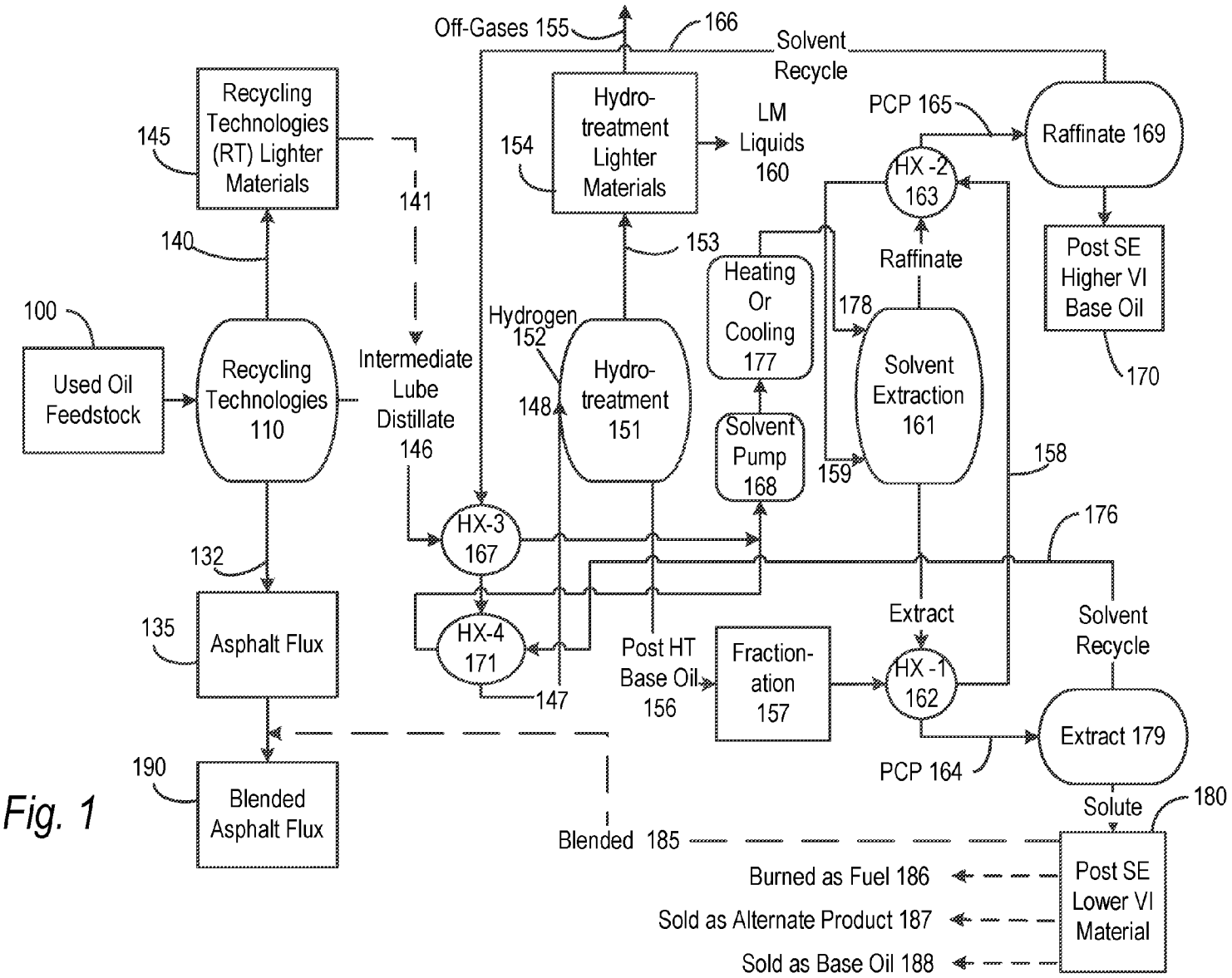
FIG. 1 is a schematic diagram of an embodiment of the invention where solvent is preferentially selective to removal of aromatics, polars and naphthenes.

Turning to FIG. 1, used oil feedstock 100 is processed using any of several recycling technologies 110 to separate out an intermediate lube distillate 146 from each of an asphalt flux 135 of higher molecular weight and recycling technologies lighter materials 145 of lower molecular weight. In recycling technologies 110, the process equipment is preferably configured to generate the lighter materials 145 (which typically consist of water, glycols, diesel, and possibly a spindle oil) in several successive steps, all of which are intended to be included within recycling technologies 110. Intermediate lube distillate 146 is preferably created from used lubricating oils, and preferably by one or more distillation steps embodied within recycling technologies 110 to separate out lighter materials 145 via a line 140 and separate out asphalt flux 135 via a line 132. As denoted by broken line 141, optionally a portion of one or more of the lighter materials 145, such as diesel and spindle oil, may be re-combined via line 141 with Intermediate lube distillate 146 and then passed on to a hydrotreatment 151 via line 147. Certain lower boiling point overhead streams in line 140 may optionally be burned for heat generation or directly marketed as a type of burner fuel.

Intermediate lube distillate 146, along with optionally some lighter materials 145 via line 141, such as diesel and spindle oil, preferably pass on to hydrotreatment 151 via line 147. Since intermediate lube distillate 146 may be stored in tankage which is at ambient temperature (not shown) and hydrotreatment 151 operates at elevated temperatures, preferably employed are heat exchangers HX-3 167 and HX-4 171 to heat intermediate lube distillate 146 even as these heat exchangers also cool a solvent recycle 166 and a solvent recycle 176. As is known in the industry, hydrotreatment 151 employs certain equipment to process the intermediate lube distillate 146 under conditions including: a) elevated temperatures, b) elevated pressures, c) residence times, d) a hydrogen stream 152 of a given purity and flow rate; all in e) the presence of one or more catalysts. Hydrotreatment 151 will preferentially achieve certain outcomes including: a) removal or conversion of aromatic and polar compounds, b) replacement of hetero-atoms (such as sulfur, nitrogen, oxygen) with hydrogen to create c) higher levels of saturates, and possibly d) opening of naphthene rings, and e) isomerization of paraffins to iso-paraffins, thereby all resulting in f) a higher quality base oil.

As known in the industry, hydrotreatment 151 preferably utilizes equipment, including pumps, heat exchangers, compressors, guard beds, reactors, amine unit for purification of the hydrogen for recovery, a recycle loop for hydrogen, and stripping and fractionation equipment. Hydrotreatment 151 preferably includes stripping and fractionation of lighter materials, neutralization of acids created during hydrotreatment, and special metallurgies for equipment. Hydrotreatment 151, via a line 153, illustrates the separation of hydrotreatment lighter materials 154 which preferably include off-gases 155 and lighter materials (LM) liquids via a line 160, which may be either utilized as burner fuel or sold as products. The fractionation and/or stripping units in hydrotreatment 151 also separate out a heavier material designated as post HT base oil 156 which is then preferably passed to solvent extraction 161 at an entry point 159. Optionally, prior to passing to solvent extraction 161 is fractionation 157 in which post HT base oil 156 is separated into base oils of different viscosities (and possibly diesel). In optional fractionation step 157, preferably pressure is reduced to a vacuum but sufficient temperature is maintained to allow post HT base oil 156 to be divided into different viscosities as would satisfy, after applying solvent extraction 161, the viscosities for the products in the intended market applications. The above areas describe hydrotreatment, stripping, and fractionation processes that are generally known to industry process engineers and do not require further detail in this specification. As disclosed next below, the invention further includes innovations where it may be preferable for a portion of the elevated temperatures and/or pressures in hydrotreatment 151 to persist in post HT base oil 156 passed to Solvent Extraction 161. All temperatures referred to herein are at atmospheric pressures.

Following hydrotreatment, post HT base oil 156 then passes to solvent extraction 161 as shown entering solvent extraction at 159. As noted previously, solvent extraction 161 is a known separations process. Separation is preferably implemented in a contactor and any of several non-limiting contactor types can be employed, such as rotating disc contactors, Karr columns, pulsed contactors, Podbielniak reactors, and counter current extraction columns (whether utilized, singly, in combination, or in series) and the like. An alternative embodiment for such a contactor in the instant invention is an atmospheric, vacuum, or flash distillation column (whether operated as normal, extractive, or azeotropic) which can utilize one or more solvents to create a higher relative volatility differential between the higher VI constituents (such as paraffinic or iso-paraffinic components) and the lower VI constituents (such as aromatic, polar or naphthenic components) of the feed stream. Such a column in this instance may have operating conditions, for example, which include a large temperature and/or pressure gradient between the upper and lower stages, and/or varied solvents may be introduced at different positions in the columns.

In the instant invention, an elevated temperature for the post HT base oil 156 from hydrotreatment 151 is optionally utilized to: a) promote extraction results by enhancing solvent power above what would otherwise occur at the typical temperature of solvent extraction (which is generally below 250° F.); and b) provide for efficient recovery of the solvent by utilizing heat in the post HT base oil 156 to reduce or eliminate the need for adding heat to vaporize the solvent to be recovered in each of a raffinate 169 and an extract 179. In the instant invention, an elevated pressure for the post HT base oil 156 from hydrotreatment 151 is optionally utilized to: a) promote extraction results by enhancing solvent options and power above what would otherwise be available and occur at the typical pressure of solvent extraction (which is generally atmospheric or at a slight positive pressure); and b) enhance recovery efficiency of solvent from either or both of the raffinate 169 and extract 179. More efficient solvent recovery using pressure is achievable for example by reducing pressure in each of extract 179 and raffinate 169 which, when operated at a temperature differential sufficiently far above the boiling point of the solvent, will result in flash evaporation and re-capture of the solvent for recycling in the process with minimal or no additional heat. If flash evaporation is employed, it should preferably not vaporize either of the post SE lower VI material 180 or the post SE higher VI base oil 170, but only vaporize the solvent. When utilized, heat and pressure are thus preferably contributed from the elevated temperature and pressures contained in post HT base oil 156 as proceeding from hydrotreatment 151.

Accordingly, disclosed in this invention is the aforementioned highly efficient means for achieving solvent recovery by separating out the solvent from the raffinate, leaving a higher VI base oil, and separating out the solvent from the extract, leaving a lower VI material (referred to as solute), with such separation optionally utilizing some or all of the elevated temperatures and/or pressures provided by hydrotreatment of the feed. The proposed innovations of elevated temperatures and pressures passed from hydrotreatment to aid in solvent recovery are not required to be utilized together and instead may be applied separately. For example, solvent extraction 161 could maintain an elevated pressure but operate below the typical temperature of 250° F., as may be used with a solvent of a low boiling temperature. Or solvent extraction 161 could be designed to maintain a temperature above 250° F., but below the boiling point of the solvent, and still operate in an atmospheric pressure range. Or a combination of the two may be utilized where some amount of elevated temperature and elevated pressure are both employed in solvent extraction 161, such as operating with a solvent extraction temperature above the boiling point of the solvent and also with sufficient elevated pressure to maintain the solvent in a liquid phase. However, to avoid excess operating cost and additional equipment cost and to promote or perhaps even enable effective separation, temperatures and pressures in solvent extraction 161 are preferably below temperatures and pressures utilized in hydrotreatment 151.

One configuration is next discussed as to how the invention preferably employs both pressure and temperature between hydrotreatment 151 and solvent extraction 161 to increase efficiency. The effluent stream from hydrotreatment 151, which is post HT base oil 156, is cooled via heat exchangers HX-1 162 and HX-2 163 even as it then simultaneously heats extract at HX-1 162 and raffinate at HX-2 163 to assist or complete the heat required for vaporization of the solvent recovery in each. Under this configuration of the invention, post HT base oil 156 preferably supports an elevated pressure, but is preferably cooled down to a temperature for solvent extraction generally above the solvent's boiling point as charged to solvent extraction 161 at entry point 159. Then after solvent at entry point 178 and post HT base oil 156 at entry point 159 have been combined in the contactor, which is part of solvent extraction 161, and have moved counter currently, applying the above noted recuperative heat exchange using the heat from hydrotreatment 151 to each of raffinate and extract to elevate their temperatures sufficiently far above the boiling point of the solvent so that when the pressure is released at pressure control points PCP 165 and PCP 164, the solvent will flash off in overhead solvent recycle streams 166 and 176, respectively. To achieve this, post HT base oil 156 may require additional cooling capacity (not shown), which would be preferably positioned after HX-2 163 and before entry point 159 (not shown). Solvent distillation in raffinate 169 and extract 179 may require additional heating capacity which is shown in heating or cooling 177, but which may be alternatively or additionally employed after, as needed, PCP 164 as part of extract 179 (not shown) and after PCP 165 as part of raffinate 169 (not shown). However, the amount of extra cooling and heating required to operate according to the invention is far less than would be required in the absence of the recuperative heat exchange noted in the invention. This approach will preferably allow for solvent recycle 166 and solvent recycle 176 to be operated either without, or with a minimum of additional, heating, stripping, or vacuum distillation equipment, and thus capital and operating cost. Similarly, heating of the intermediate lube distillate 146 in each of HX-3 167 and HX-4 171 prior to entry point 148 into hydrotreatment 151 is provided by also cooling of solvent recovery streams 166 and 176, respectively, although additional heating equipment may be required (not shown) to attain the optimal operating temperature in hydrotreatment 151.

An additional innovation that may be utilized is to control the pressure of each of raffinate 169 (such pressure control point shown illustratively at PCP 165) and extract 179 (such pressure control point shown illustratively at PCP 164) as to be sufficiently below that of solvent extraction 161 as a means of regulating the flow of material through solvent extraction 161 to a desired solvent to oil ratio, thus prospectively minimizing or eliminating use of pumps to solvent extraction 161. If the contactor in solvent extraction 161 is operated at a positive pressure (above atmospheric), there is preferably a pump 168 for re-pressurizing solvent recycle 166 and solvent recycle 176 for returning this as liquid at the proper pressure to solvent extraction 161 at point 178. Also prior to pump 168 equipment are heat exchangers HX-3 167 and HX-4 171 which are preferably employed to change the solvent's phase from gas to liquid state or to further cool the solvent if needed. As noted, heating or cooling 177 is also preferably employed after pump 168 to heat or cool the solvent as needed.

For maximum operating and capital efficiency for solvent recovery, an alternative means of operating solvent extraction 161 is at a temperature that is sufficiently in excess of the boiling point of the solvent and at a pressure that maintains the solvent in a liquid state at the elevated temperature. (However, in seeking higher temperatures, considerations of solvent selection and excessive miscibility may prevent adequate separation as it may become difficult or impossible to achieve at elevated temperatures.) By way of example, a preferred solvent for this invention is N-methyl-2-pyrrollidone (or NMP) which has a boiling temperature of 395° F. In this mode, temperatures above 395° F. would require equipment to be operated at a high enough pressure to maintain both the solvent and oil in a liquid state within solvent extraction 161 and in each of HX-1 162 and HX-2 163. This state is referred to as supercritical, which is a temperature and pressure where the material is liquid until pressure is released whereupon it then becomes a gas. If solvent extraction 161 is maintained in a supercritical state, then this allows a subsequent release of pressure to vaporize the solvent in raffinate 169 and extract 179, with a minimum of added heat, stripping, or creation of a vacuum. The bottoms material that is not solvent (the base oil from the raffinate or the solute from the extract) thus preferably does not become a gas and is collected separately from the solvent. An additional advantage of operating at the higher temperatures and pressures is that the purity of the product that is created in post SE higher VI base oil 170 will be higher than if the solvent extraction 161 were to be operated at a traditional temperature of below 250° F. and at 1 atmosphere. However, associated with any higher temperature and pressure is a shift in yield from post SE higher VI base oil 170 to the post SE lower VI material 180 and is one factor to be optimized when selecting the optimum temperature to be used in solvent extraction 161. Considerations of elevated temperature should thus not only include thermal efficiency and desired product quality, but also reflect desired throughput and yields, as high levels of miscibility between the oil and solvent at higher temperatures can result in poor separation. To reduce this issue, a significant temperature gradient may preferably be employed across the contactor with the high temperature at the solvent entry point and the low temperature of the gradient at the extract exit point, or a recycle loop may be employed (not shown).

To minimize capital and operating costs in solvent recovery, it may be preferable to avoid the need for: a) addition of separate heat or cooling; b) pressure below 1 atmosphere (e.g., some level of vacuum); or c) a stripping capability. The alternative operating conditions noted next will assist in specifying the operating parameters for solvent extraction 161 and prospectively minimize or eliminate the need for heat exchangers HX-1 and HX-2. To promote full solvent recovery in both of the raffinate 169 or extract 179 for the least cost, the loss of heat and drop in temperature resulting from solvent vaporization preferably shall not cool the remaining liquid to below the solvent's boiling point at atmospheric pressure. Since the amount of solvent to be vaporized relative to the bottoms (whether post SE higher VI base oil or post SE lower VI material) is generally largest in extract 179, to minimize capital and operating cost, the temperature of solvent extraction 161 may be determined to be that temperature needed to achieve full vaporization of the solvent recycle 176 in extract 179 after pressure is released downstream of PCP 164. This will logically be affected by the solvent selected and the dosage (that is, the ratio of the solvent introduced in 178 to the oil introduced in 159) with a higher solvent-to-oil ratio (dosage) necessitating higher heat in solvent Extraction 161 to provide for sufficient heat as needed to achieve full solvent vaporization in extract 179. The level of heating or cooling of the solvent to reach the optimum temperature in solvent extraction 161 is preferably controlled by heating or cooling 177.

In solvent extraction 161, the solvent-to-oil ratio is one of several key variables with others, including choice of solvent, extraction contactor type(s), temperature, temperature gradient in the contactor, flow rate, and addition of a further polar solvent such as water to improve selectivity and the inclusion, or not, of a recycle loop. The solvent-to-oil ratio will be affected by a desired VI for post SE higher VI base oil 170, as well as desired product quality characteristics for post SE lower VI material 180. The higher the solvent-to-oil ratio, the higher will be the VI of post SE higher VI base oil 170. Additional factors include the quality of used oil feedstock 100, the choice of recycling technologies 110, and degree of severity of hydrotreatment 151. Generally speaking for the preferable solvent of NMP, the solvent-to-oil ratio is preferably in the range of about 0.2 to 10, usually in the range of 0.5 to 4, and most preferably in the range of 1 to 3.

Economics and operability considerations should be generally weighed along with the desired base oil's yield, product quality, and performance characteristics. In addition to the elevated temperature and pressure and varied solvent-to-oil ratios, design of solvent extraction 161 will preferably include other factors such as extract equipment selection, solvent selection (preferably NMP), solvent recycle purity, and stripping, if preferred. Injection of water or an extract recycle loop to promote solvent selectivity may also be employed, although water addition would be adverse to performing solvent extraction at elevated temperatures (in the absence of higher pressures) due to water's 212° F. boiling point. Prospectively, a co-solvent may be used to enhance extraction efficiency and product quality. Design of solvent extraction 161 will also reflect factors such as operability (that is, controllability) of the process, capital cost, operating cost (including solvent loss and degradation), corrosion control, maintenance cost, capacity, up-time, operating safety and risk, and equipment availability.

Solvent extraction 161 thus results in two streams, one leading to raffinate 169 and the other to extract 179. Raffinate contains a higher VI base oil rich stream that also contains solvent, which in raffinate 169 is distilled and recovered for re-use via solvent recycle 166, leaving then post SE higher VI base oil 170. Extract 179 contains a solvent rich extract stream that contains a lower VI material called solute. Extract 179 includes distillation to recover solvent for re-use via solvent recycle 176, leaving the solute which is post SE lower VI material 180 and which preferably contains a higher portion of naphthene, aromatic and polar compounds than is found in post SE higher VI base oil 170. In each of raffinate 169 and extract 169, the solvent is thus recycled for use in the process. The total of the naphthene, polar and aromatic compounds in post SE higher VI base oil 170 will then be lower than those found in post HT base oil 180 (and conversely the saturates will be higher). Since the naphthene, aromatic and polar compounds in post SE lower VI material 180 are low VI and were removed from post HT base oil 156, post SE higher VI base oil 170 is higher in VI than is post HT base oil 156, and benefits from the phenomenon known as VI Hop, as noted above, versus post SE lower VI material 180.

Under certain combinations of used oil feedstock 100, recycling technologies 110, or process conditions of hydrotreatment 151 or solvent extraction 161, the post SE lower VI material 180 (as the aromatics and polar rich stream created from extract 179) may not be marketable as a base oil. However, depending on the quality of the used oil feedstock 100, hydrotreatment severity in hydrotreatment 151, and solvent selection and severity in solvent extraction 161, the post SE lower VI material 180 may be sufficiently low in poly nuclear aromatics (PNAs), which are known carcinogens, to be sold in market applications (such as, for example, in rubber or tire manufacturing) as shown in 187 where a solute from a solvent extraction process applied to a non-hydrotreated feed stream would otherwise be rejected. Optionally, post SE lower VI material 180 may be blended into the asphalt flux created in the distillation phase as shown in blended 185. Finally, it may be burned as fuel as shown in 186.

A final determination of operating conditions for each of hydrotreatment 151 and solvent extraction 161 may be set by determining desired end product levels of saturation, sulfur, and VI, for the post SE higher VI base oil 170 and the post SE lower VI material 180 (which is preferably sold as a base oil as shown in 188) and then balancing between the operating parameters of each of hydrotreatment 151 and solvent extraction 161 to create the desired product qualities for the highest yield and least operating cost. For example hydrotreatment 151 is most suited for hydrogenating (and thus removing) sulfur, nitrogen, or oxygen hetero-atoms and also for naphthene ring opening, and in some circumstances, isomerization to create iso-paraffins.

Solvent extraction 161 is well suited for separating aromatics and polars that are not removed by hydrotreatment 151 into a higher VI and lower VI stream, and it can also be used to preferentially separate paraffinic components from naphthenic components (both of which are saturates). A further example of a potentially improved outcome is where a type of aromatic can be converted into a saturate in hydrotreatment 151, but where that saturate is a low VI saturate (such as a naphthene), it may be preferable in hydrotreatment 151 not to convert all or some of the aromatics or polar compounds into the lower VI material but instead remove these later in solvent extraction 161 from the higher VI base oil stream. While the higher VI base oil would then have lower yield, the improvement in product quality in the higher VI base oil may more than offset the loss in its yield. These are optimizations by which the process conditions of hydrotreatment 151 and solvent extraction 161 may be altered to deliver one or more improved outcomes to create a better result versus than could be achieved by either hydrotreatment or solvent extraction alone.

Figure 2:
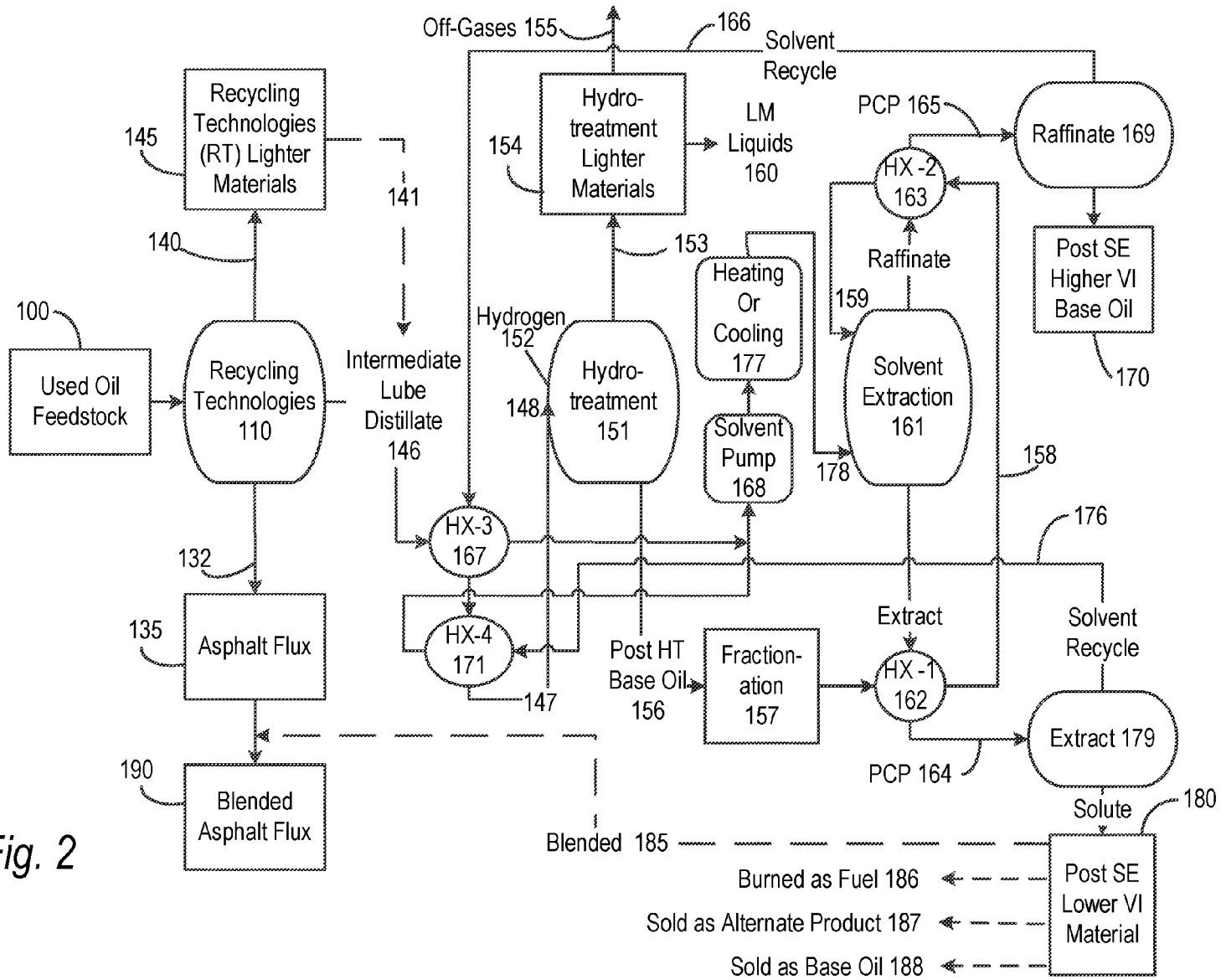
FIG. 2 is a schematic diagram of an embodiment of the invention where the solvent is preferentially selective to removal of paraffinics.

Next disclosed as shown in FIG. 2 is an alternative mode for implementing additional post hydrotreatment finishing of lubricating oils by means of using a solvent which preferentially removes paraffinic compounds. In FIG. 2 the process flows are the same as in FIG. 1, except that in this case the solvent used is less dense than the Post HT base oil 156 and is preferentially selective to removing paraffinic components versus removing aromatic, polar, and naphthenic components. Therefore in FIG. 2 the solvent is shown entering Solvent Extraction 161 at point 178 near the bottom of the contactor and the Post HT base oil 156 enters Solvent Extraction 161 at point 159 near the top of the contactor. In the case of use of a solvent (such as propane) that is a gas at the contactor's operating temperature, a compressor is preferentially used as Solvent Pump 168 to convert the (propane) gas into a liquid phase for re-use in the process.

Figure 3:
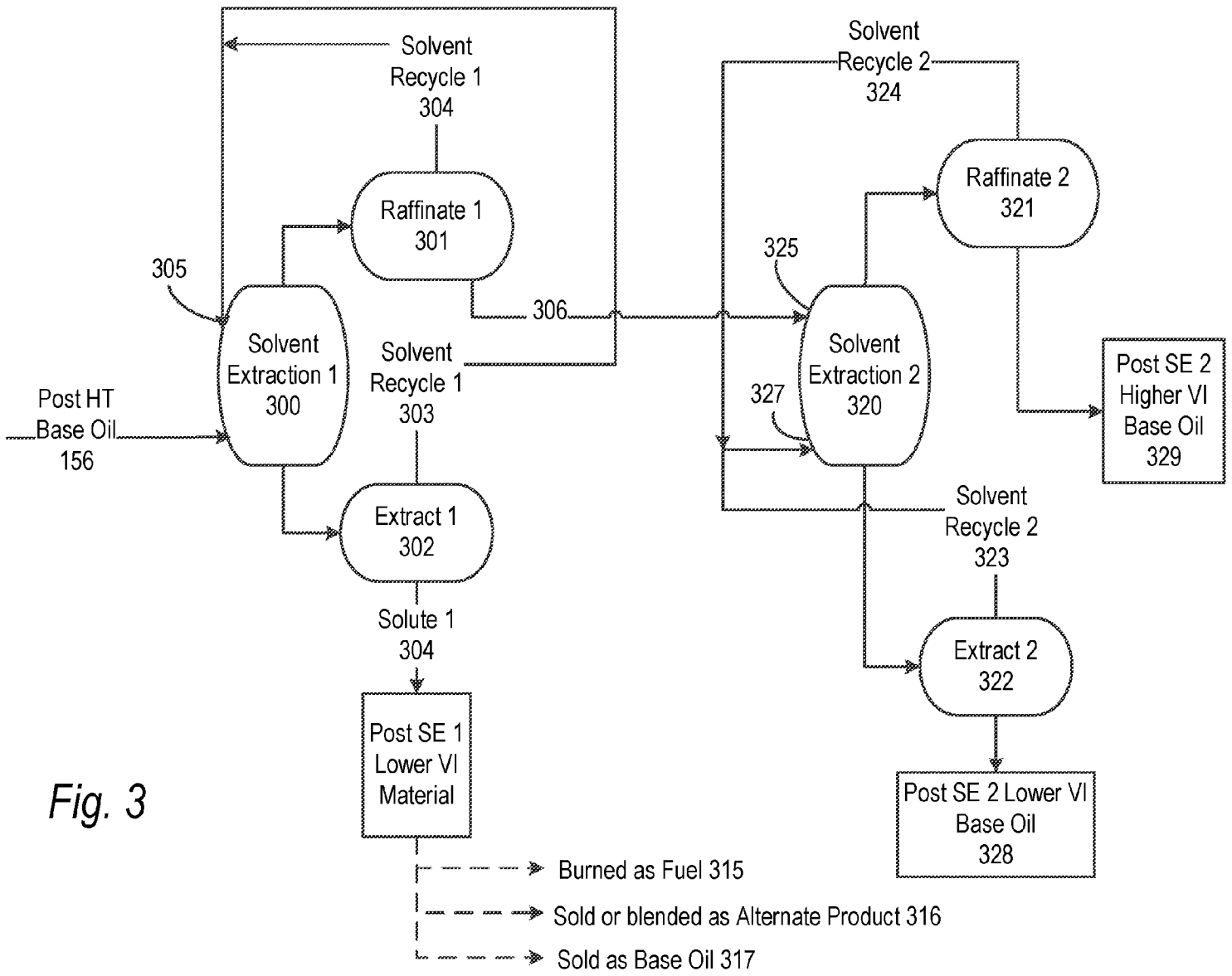
FIG. 3 is a simplified schematic diagram of an embodiment of the invention where two solvents are utilized in sequence, one being a solvent preferentially selective to the removal of aromatics, polars, and naphthenes and the other solvent being preferentially selective to removal of paraffinics.

A further embodiment is shown in FIG. 3 in which Raffinate stream 169 from the solvent extraction process described above in FIG. 1 is then further processed via treatment with the paraffinic extraction process described above in FIG. 2. Assuming a preferentially selective aromatic/polar/naphthenic solvent that is more dense than the base oil field is used first in the solvent treatment processes, then turning to FIG. 3 the Post HT Base Oil stream 156 (as is created in FIGS. 1 and 2 and optionally either before or after Fractionation step 157) is charged to the lower area of Solvent Extraction 1 300 (a contactor) and Solvent Recycle 1 (303 and 304) is charged to the upper area of Solvent Extraction 1 300 at point 305. From Solvent Extraction 1 300 Raffinate 1 301 is generated above and Extract 1 302 is generated below. Raffinate 1 301 is the higher paraffinic, higher VI stream and Extract 1 302 is the higher naphthenic, lower VI stream. As noted, solvent is recovered from Raffinate 1 300 via Solvent Recycle 1 304 and solvent is recovered from Extract 1 via Solvent Recycle 1 303, each of which is charged back to Solvent Extraction 1 300 at point 305. Solute 1 304 is preferably sold as Base Oil 317, but if it should not achieve base oil specifications then it may be sold or blended in the asphalt stream as an Alternate Product 316 or burned as Fuel 315.

After removal of the solvent in Raffinate 1 301, stream 306 is generated and charged to Solvent Extraction 2 320 at point 325. The preferentially selective paraffinic solvent that is less dense than the base oil is field is generated in Solvent Recycle 2 324 and Solvent Recycle 2 323 and charged to the Solvent Extraction 2 320 at point 327. From the bottom of contactor Solvent Extraction 2 320 is generated Extract 2 322, which after solvent removal, then becomes Post SE 2 Lower VI Base Oil 328. From the top of contactor Solvent Extraction 2 320 is generated Raffinate 2 321, which after solvent removal, then becomes Post SE 2 Higher VI Base Oil 329. In the order of the expected quality level from highest to lowest, Base Oil 329 will be higher quality than Base Oil 328, which will in turn be higher quality than Base Oil 317.

Alternatively FIG. 3 could be altered quite easily in which a sequence configuration is employed where the paraffinic selective extraction process described above is applied first to the Post HT Base oil 156 stream and the aromatics, polars, napthenic selective solvent is applied second to the raffinate stream. This also will then create a higher paraffinic and higher VI raffinate stream than could be created by using either of the two solvents alone. Finally an alternative configuration is also disclosed wherein two solvents, one preferentially selective to aromatics/polars/naphthenes removal and one preferentially selective to paraffins removal may be applied in a single contactor. Such alternative embodiments of the instant invention in which solvent treatment is applied to a hydrotreated lube oil as are described herein are believed to be within the capabilities of one of ordinary skill in the art.

Figure 4:
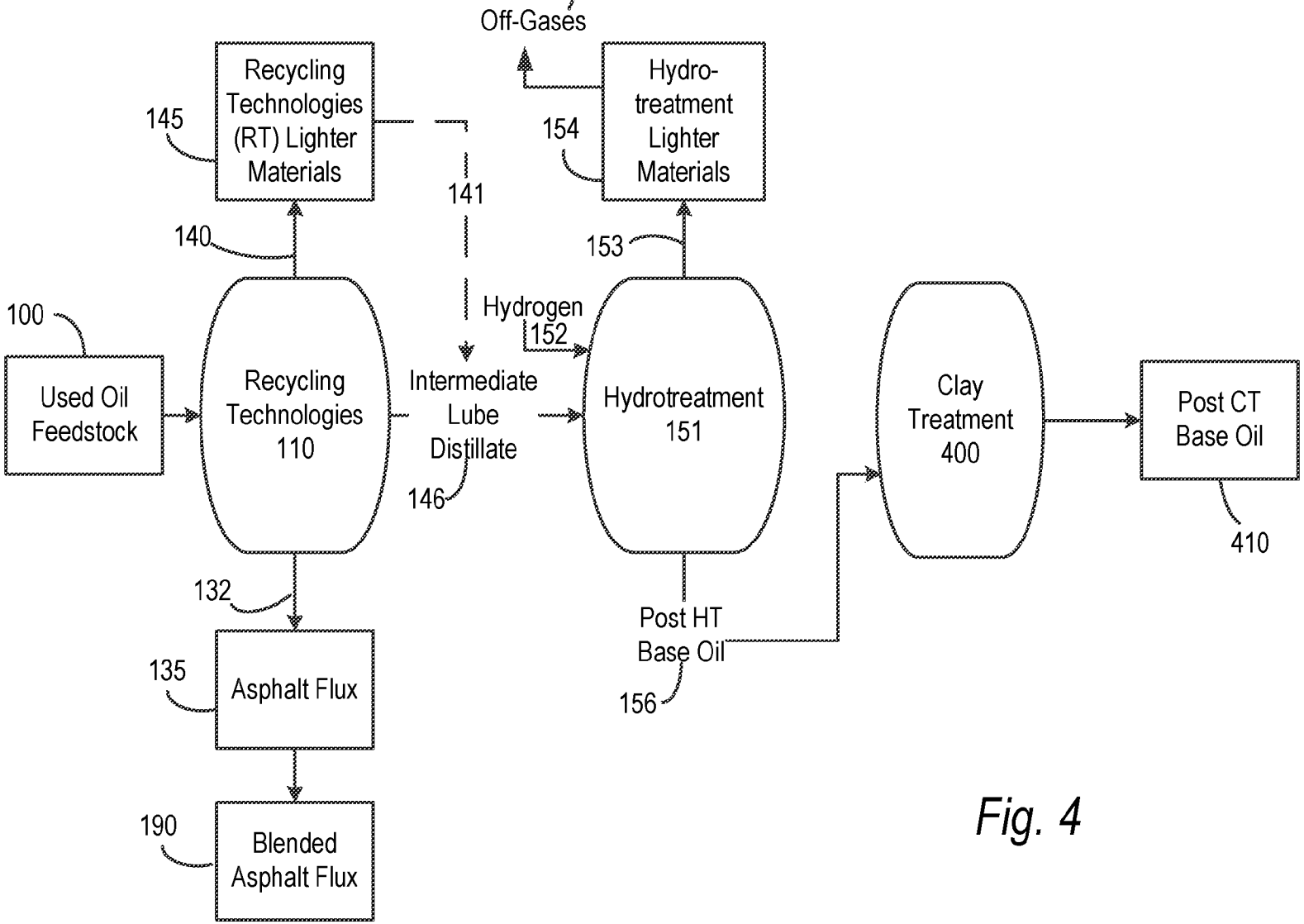
FIG. 4 is a schematic diagram of an embodiment of the invention where hydrotreatment is followed by clay treating.

Next disclosed is an alternative mode for implementing additional post hydrotreatment finishing of lubricating oils by means of Clay Treatment, as shown in FIG. 4. Used Oil Feedstock 100 is processed via Recycling Technologies 110 to generate Intermediate Lube Distillate 146, which is then charged to Hydrotreatment 151. Post HT Base Oil 156 is charged to Clay Treatment 400 using temperature, residence time and capacities as are appropriate to the clay utilized in the treating process. During Clay Treatment 400 polar impurities including nitrogen, oxygen, and sulfur containing compounds are adsorbed onto the clay and removed from the Post HT Base Oil 156. Periodically the clay is regenerated and re-used in the process based on the manufacturer's specifications for this process (regeneration and re-use cycles not shown). The resultant Post CT Base Oil 410 is thus further improved over the Post HT Base Oil 156.

The instant invention as described herein preferably describes the intermediate lube distillate subject to hydrotreatment as derived from an intermediate lube distillate created from used lubricating oil which is then solvent treated or clay treated as per the instant invention. However an alternative embodiment, and thus an alternative application, is where the intermediate lube distillate may instead be derived from crude oil which has been processed as described herein to create hydrotreated base oil which is then solvent treated or clay treated as per the instant invention. A further alternate embodiment is to utilize hydrotreated base oil (say from the open market) and apply solvent treatment to this hydrotreated base oil, thus utilizing solvent treatment a period of time that is significantly later than when the original hydrotreated base oil was manufactured. Furthermore the subsequent solvent treatment (or clay treatment) may be undertaken at a separate, remote location from where the hydrotreated base oil was created, even prospectively in modular, or mobile, units. Applications of such alternative embodiments are believed to be well within the capabilities of one of ordinary skill in the art and, as such, are intended to lie within the scope of the instant invention.

Suitable catalysts and operating conditions in hydrotreatment may be optimized as known to the art. Such catalysts typically comprise nickel molybdenum, cobalt molybdenum, platinum, palladium, and other catalysts as may be employed for de-sulfurization, de-nitrification, saturation, naphthene ring opening, and/or isomerization.

Solvents are also known to the art for selectively separating aromatics, polars and other undesirable base lube oil constituents from desirable base lube oil constituents. Preferred solvents typically comprise N-methyl-2-pyrollidone, furfural, phenol, and the like. The optimum solvent may be selected based upon its effectiveness in the process as discussed.

Other solvents are also known to the art for their preferential selectivity to paraffinic components. Preferred solvents typically comprise propane, acetone, hexane, heptane, isopropyl alcohol, and the like. The optimum solvent may be selected based upon its effectiveness in the process as discussed.

The present invention is not limited to any particular solvent or catalyst since feedstocks and more detailed technology and process conditions may vary.

While the present invention has been described by reference to certain of its preferred embodiments, the embodiments presented here are intended to be illustrative rather than limiting in nature and many variations and modifications are possible within the scope of the present invention. Many such variations may be considered obvious and desirable by those skilled in the art based upon a review of the foregoing description of the preferred embodiments that are described in this specification.

What is claimed is:

1. A method comprising a step of applying to a hydrotreated base oil a solvent treatment comprising at least one solvent utilized to extract naphthenic compounds to produce:

a first base oil comprising a higher proportion of paraffinic compounds than occurred in said hydrotreated base oil, wherein said first base oil has a viscosity index of at least 112; and at least one additional base oil comprising a higher proportion of naphthenic compounds than occurred in said hydrotreated base oil.

2. The method of claim 1 wherein said hydrotreated base oil contains at least 90% saturates.

3. The method of claim 1 wherein said hydrotreated base oil contains less than 300 PPM of sulfur.

4. The method of claim 1 wherein said hydrotreated base oil contains a viscosity index of at least 80.

5. The method of claim 1 wherein said first base oil is a Group III base oil.

6. The method of claim 1 wherein said first base oil has a viscosity index of at least 120.

7. The method of claim 1 wherein at least 50% of said hydrotreated base oil has a boiling range between 550 degrees Fahrenheit and 1050 degrees Fahrenheit.

8. The method of claim 1 wherein said first base oil has a higher viscosity index than said hydrotreated base oil.

9. The method of claim 1 wherein the at least one solvent is at least one first solvent, and wherein the method further comprises a step of utilizing at least one second solvent to extract paraffinic compounds from at least of one of said first base oil and said at least one additional base oil.

10. The method of claim 1 wherein said hydrotreated base oil has been hydrotreated under a pressure of at least 800 psig.

11. The method of claim 1 further comprising a step of deriving said hydrotreated base oil from at least one of used oil and crude oil.

12. A method comprising steps of:

applying to a hydrotreated base oil a solvent treatment comprising at least one first solvent utilized to extract naphthenic compounds to produce:

a first base oil comprising a higher proportion of paraffinic compounds than occurred in said hydrotreated base oil; and at least one additional base oil comprising a higher proportion of naphthenic compounds than occurred in said hydrotreated base oil; and utilizing at least one second solvent to extract paraffinic compounds from at least of one of said first base oil and said at least one additional base oil.

* * * * *